United States Patent [19]

Dai

[11] Patent Number: 4,912,947

[45] Date of Patent: Apr. 3, 1990

[54] WASHING MACHINE HAVING IMPROVED STRUCTURE SIMULATING ACTION OF HAND LAUNDRIES

[76] Inventor: Wen-Tzong Dai, No. 15, alley 16, section 2, Chung-san N. Rd., Taipei, Taiwan

[21] Appl. No.: 101,950

[22] Filed: Sep. 25, 1987

[51] Int. Cl.[4] ..... D06F 15/00

[52] U.S. Cl. ..... 68/23.7; 68/89; 68/90; 68/134; 68/54

[58] Field of Search ..... 68/28, 31, 33–35, 68/89, 43, 131–134, 53, 54, 113, 38, 63, 84, 90, 92, 93, 23.7; 366/302, 306, 307

[56] References Cited

U.S. PATENT DOCUMENTS

| | | | |
|---|---|---|---|
| 750,419 | 1/1904 | Allen | 68/28 X |
| 929,222 | 7/1909 | Hopkins | 68/89 |
| 1,376,255 | 4/1921 | Clugg | 68/54 |
| 1,917,867 | 7/1933 | Barker | 68/54 |
| 1,930,241 | 10/1933 | Labisky | 68/133 X |
| 2,272,541 | 2/1942 | Blake | 68/133 |
| 3,276,228 | 10/1966 | Ruiz | 68/28 X |

*Primary Examiner*—Philip R. Coe
*Assistant Examiner*—Stephen F. Gerrity
*Attorney, Agent, or Firm*—Larson and Taylor

[57] ABSTRACT

A washing machine 10V having a water tank 20, a relatively rotatable shaft 30 mounted in the center of the tank, a first set of washing boards 40S mounted to the tank and a second set of washing boards 40M mounted to shaft 30. Washing boards 40M and 40S rotate relative to one another and extend radially toward each other. Both sets of washing boards are flexible and are generally rectangular in plan view. In operation, the relative movement between the shaft and the tank causes the tip sides of the two sets of washing boards to pass proximate to each other so as to simulate the kneading and rubbing action of a hand laundry.

17 Claims, 7 Drawing Sheets

WASHING MACHINE HAVING IMPROVED STRUCTURE SIMULATING ACTION OF HAND LAUNDRIES

The present invention relates generally to washing machine and more particularly to washing machine having improved structure capable of simulating kneading and rubbing actions in hand laundry.

The drawbacks usually accused of in a conventional washing machine including the failure to give a thorough cleaning due to its incapability of doing kneading and rubbing actions like hand laundry, and the entanglement of the articles and formation of granulation on the fabric surface as a result of a high rotational speed of the machine. Besides, the large amount of water required in machine washing is considered to be wasteful.

Therefore, the main object of the present invention is to provide a washing machine having an improved structure obtained by installing counter displaceable kneading and rubbing boards, respectively, on the rotating shaft of the inner wall of the water tank. The boards are made of resilient material such as rubber or "koroseal", a type of artificial rubber. The boards have vertical rib stripes so that as rotation or oscillation occurs between relative board surfaces, a simulation of kneading and rubbing results.

Another object of the present invention is to provide an improved washing machine with a relatively low speed that is also capable of doing the cleaning job on articles of various material. The motion can be rotational or oscillational. There is no entanglement, surface granulation or damage to the material.

A further object of the present invention is to provide an improved washing machine wherein the consumption of water is greatly reduced due to the increase in washing efficiency resulting from said structural improvement.

The moving part of a washing machine is generally located in the center of a washing tank and comprises a rotatable disc or shaft capable of rotating or oscillating, when centrifuging is called for draining, a whirling basket with a plurality of perforations may also be included the machine can be of vertical or horizontal type.

In a preferred embodiment of the present invention, the machine is of vertical type. A pair of movable, rectangular washing boards made of a resilient material having a plurality of vertically spaced ribs thereon are diametrically disposed upon a vertical shaft. Fixedly mounted opposite to said movable washing boards, 180 apart on the inside wall of the machine tank, are a pair of stationary boards of a similar material and shape. The relative motion between the stationary and movable boards simulates the kneading and rubbing action of hand laundry.

In a second embodiment of the present invention, the machine is of horizontal type. Other than a horizontally disposed shaft and a plurality of washing boards mounted thereupon, an additional horizontal whirling drum or basket is disposed inside the basket wall, concentrically with the shaft, burring also washing boards fixed thereon. Th basket is capable of either rotating simultaneously get counter directionally with the shaft in washing mode, or whirling independently to drain water with the shaft staying unmoved during the draining period. The counter directional movement of the basket relative to the shaft is made possible through the transmission from the power source of a well designed gear train. The selection of move or stay of the shaft in washing or draining mode is controlled by a ratchet wheel means of known type.

Other features and advantages of the present invention will become apparent through the following detailed description of embodiments in accompaniment with the annexed drawings.

Figure 1:
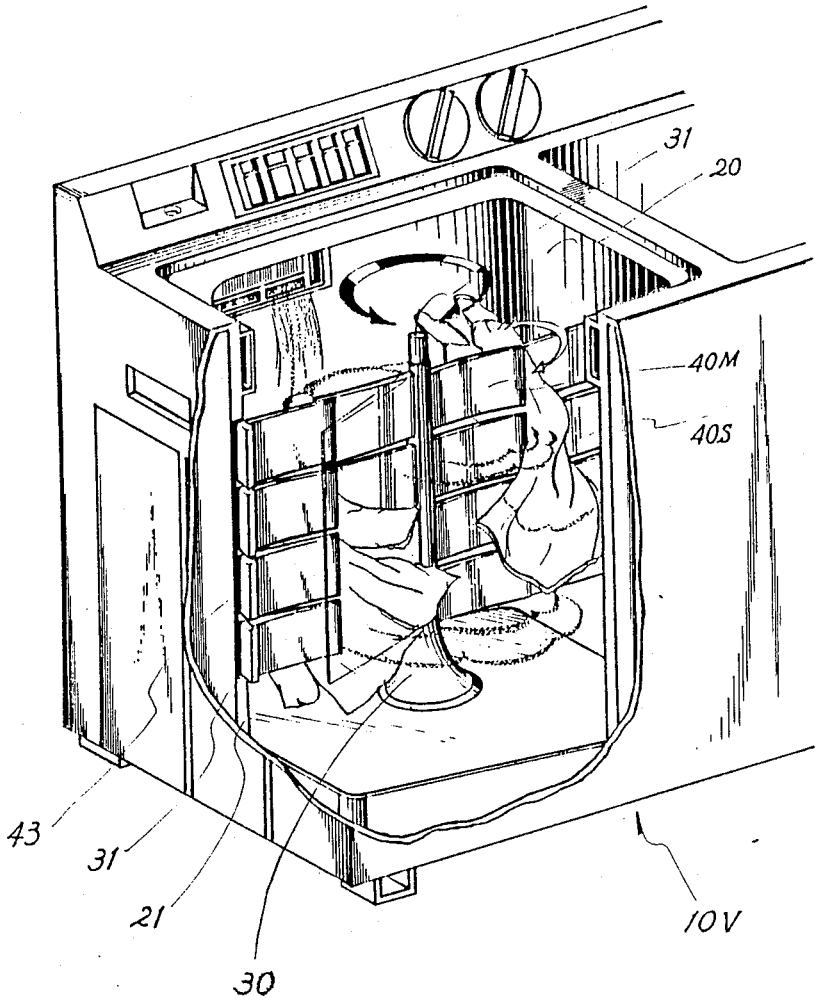
FIG. 1 is a perspective view of a vertical type washing machine of the first embodiment of the present invention, with partial cut away to show the superimposing or overlapping of board tips.
Figure 4:
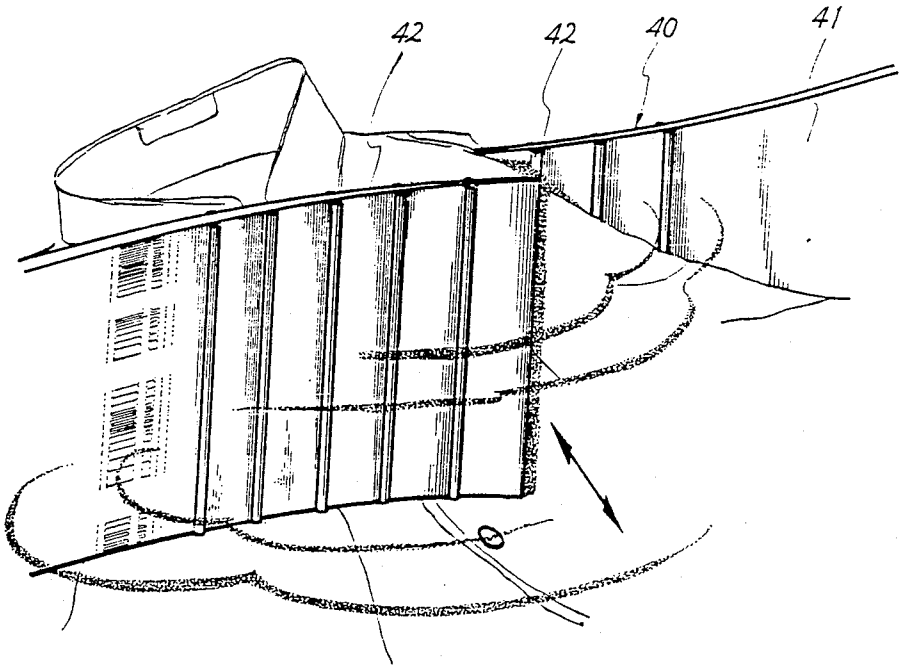
FIG. 4 is a schematic perspective showing a skirt being kneaded and rubbed between a pair of the washing boards.

Now referring to FIGS. 1 and 4, the vertical type washing machine 10V comprises a tank body 20 having an inner wall 21. A plurality of stationary washing boards 40S (four being shown, namely S1, S2, S3, and S4) are mounted on wall 21. A rotatable shaft 30 located vertically at the center portion of the tank 20 is capable of being independently set to perform revolving, oscillating intermittently at a predetermined angle, to cause a turbulence or eddy current suitable for washing of articles of various material and shape, movable washing board such as 40M (M1 to M4 are shown) are mounted on the shaft in a same manner and the shaft 30 is driven through conventional means (not shown). The structure and mounting of said washing board is to be detailed hereunder.

Figure 2A:
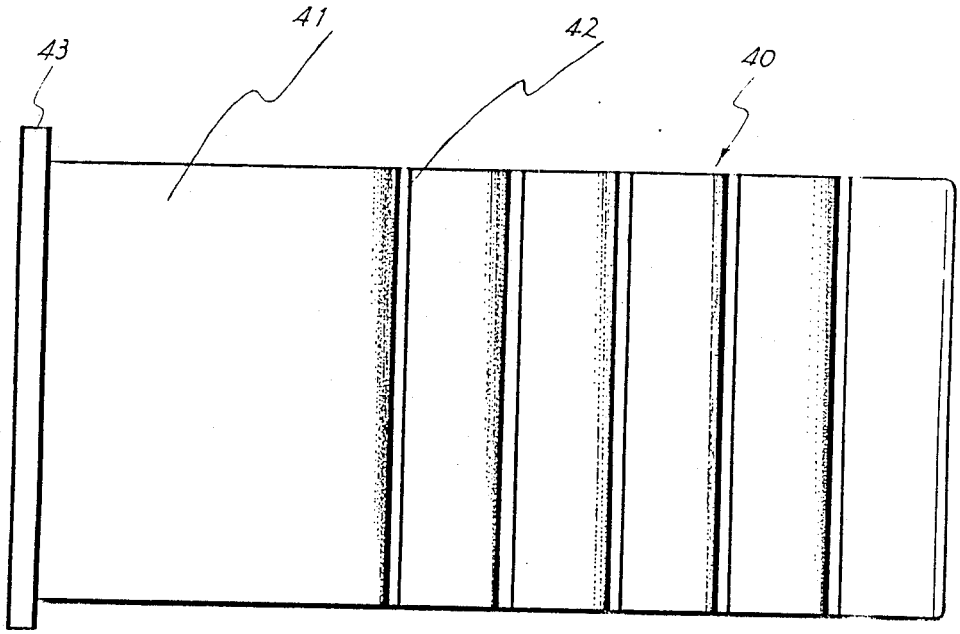
FIG. 2A, 2B depicts respectively a front elevation and a top view of a washing board according to the present invention.
Figure 2B:
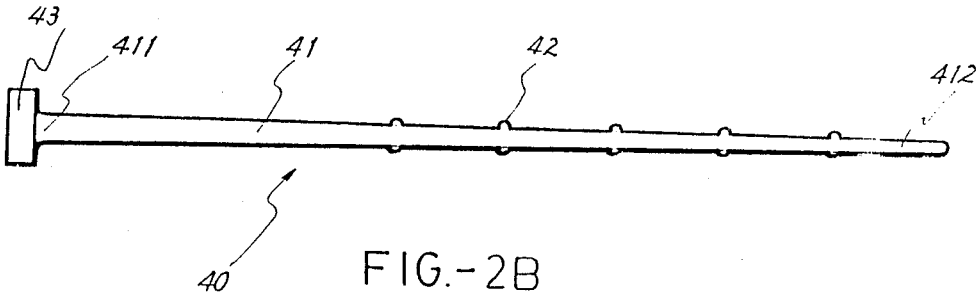
Figure 3:
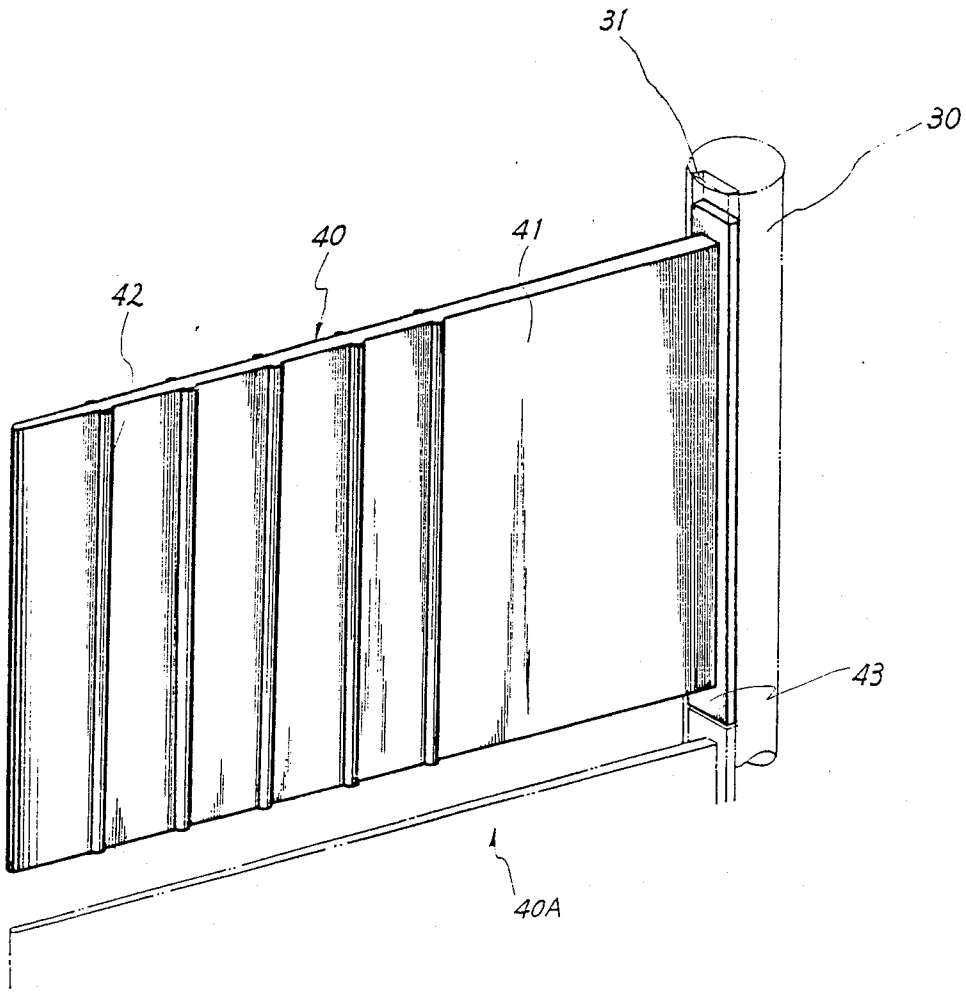
FIG. 3 is a perspective view showing the mounting of related washing boards onto a revolving shaft of a washing machine.

As shown in FIGS. 2 and 3, the wash board 40 is generally rectangular in shape in elevational view and is made of a resilient and flexible material such as rubber or "koroseal", a type of artificial rubber. Wash board 40 has a body 41 that generally has a wedge or fin shape in plan view with a root portion 411 being thicker than a tip 412. The end of the root portion 411 is provided with a mounting shoulder 43 which is to be inserted into a longitudinal slot 31 (FIG. 1) disposed on the shaft surface or alongside the inner wall 21 of the tank 20. A plurality of ribs 42 having semi-circular cross section are deployed vertically apart on both surfaces of the board 40.

The dimensions of the individual board 40 are not restricted, where root-to-tip length can be varied to cope with different requirements when articles of various material are to be washed. Preferably, the tip 412 of stationary board 40S and that of movable board 40M can be overlapped or superimposed, such as shown in FIG. 4, to an extent of 1/5 to $\frac{1}{4}$ of the root-to-tip length.

Thus, as depicted in FIG. 4, the situation of the washing process wherein a shirt is floating between two board bodies 41—41 can be achieved. In this way the superimposed parts of the boards have their ribs passing to each other to simulate the kneading and rubbing operation of hand laundry. The washing can thereby be thorough and the cleaning more effective. Due to the increased efficiency, the amount of water used also can be considerably reduced. The resiliency and flexibility of the board material do not cause any damage to the material washed.

Figure 5:
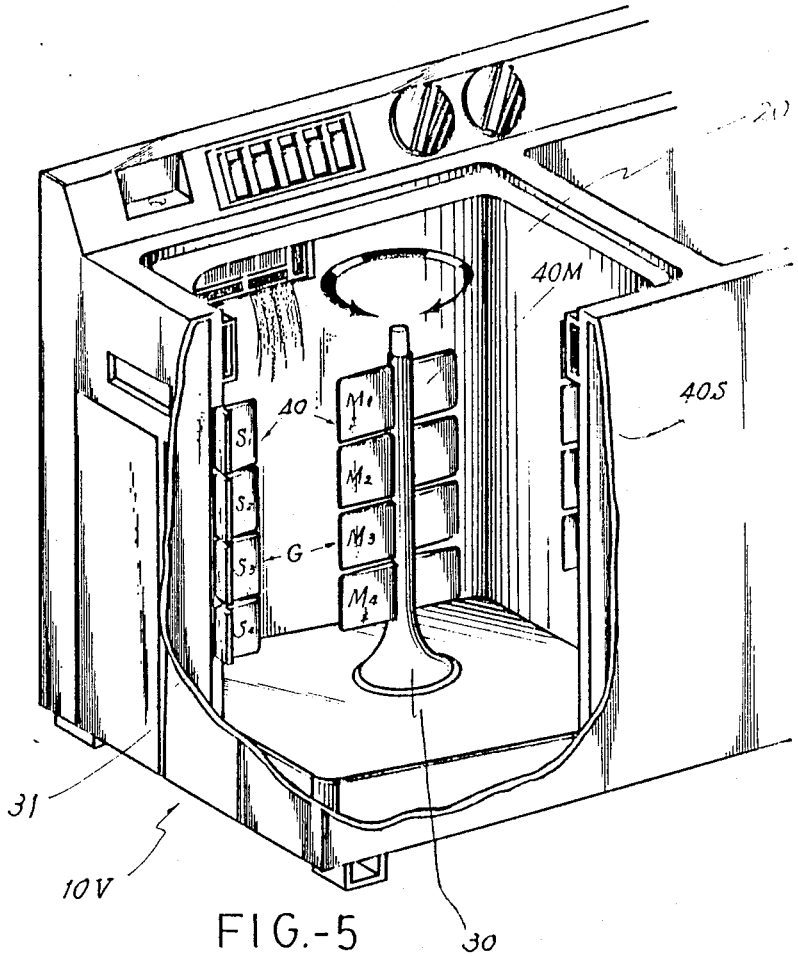
FIG. 5 is a perspective cut array similar to FIG. 1, with tips of stationary boards departed from those of moving boards.

The length of the boards may also be reduced to such as shown in FIG. 5, wherein boards 40S are spaced from boards 40M providing a gap G between board tips. This configuration facilitates the washing of heavy material, and with the rotational speed of the shaft being adjusted to be very slow, the entanglement of the washing article as well as granulation on the fabric surface can be substantially avoided.

The efficiency can be further improved by the modification of the following:

(1) To make the stationary board also displaceable to enhance the effect of hand laundry simulation;

(2) To develop full extent utilization of low levels of water, in other words, to render the shaft horizontal, so that full part of the board which have the opportunity to be totally under water;

(3) To better the control of machine speed via variations both through the motor driving speed as well as the gearing ratio; and (4) An extra merit of reducing machine bulk by incorporation of the draining function.

This can be done by way of the embodiment shown in FIGS. 6 to 9.

Figure 6:
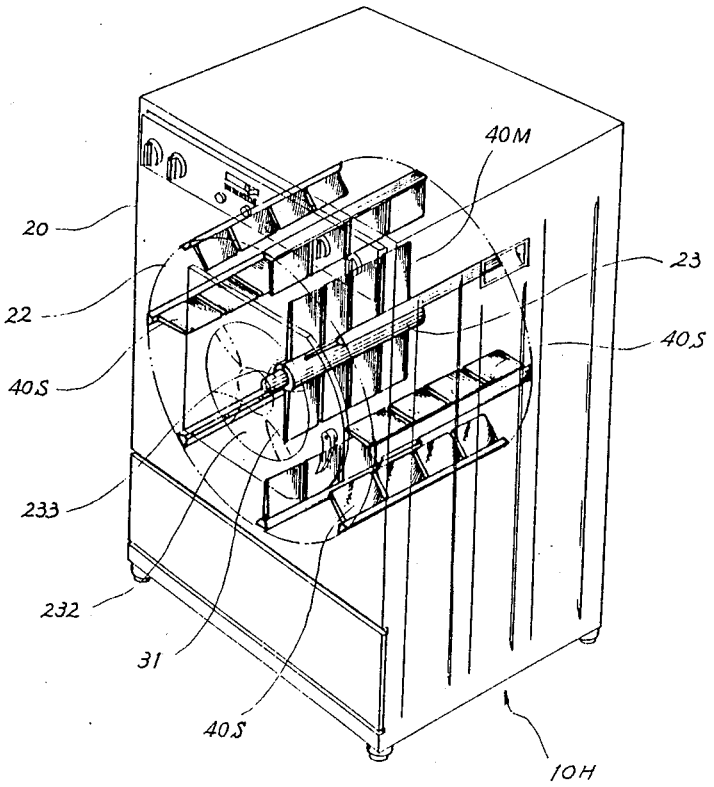
FIG. 6 is a perspective view of a second embodiment of the present invention showing generally the inside layout of a horizontal type washing machine.

In FIG. 6, a horizontal shaft washing machine 10H is provided with a washing tank 20, a horizontal rotatable drum or basket 22 and a washing shaft 23 having a counter direction of rotation with basket 22 and which is concentrically disposed with said basket 22. Washing board members 40 are provided both on the shaft 23 and the inner wall of the basket 22 and have a mutual relative motion. In this embodiment, tips of opposite board members are not overlapped or superimposed, but have a gap G in between to facilitate the washing of articles of heavy materials. The said machine would perform the draining function in the meantime, with the extra function which the machine bulk remains unexpanded, a result of space economy is achieved.

Figure 8:
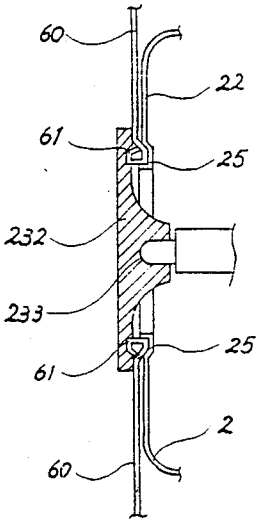
FIG. 8 is an enlarged sectional view showing the retaining of the basket end and the shaft end.
Figure 7:
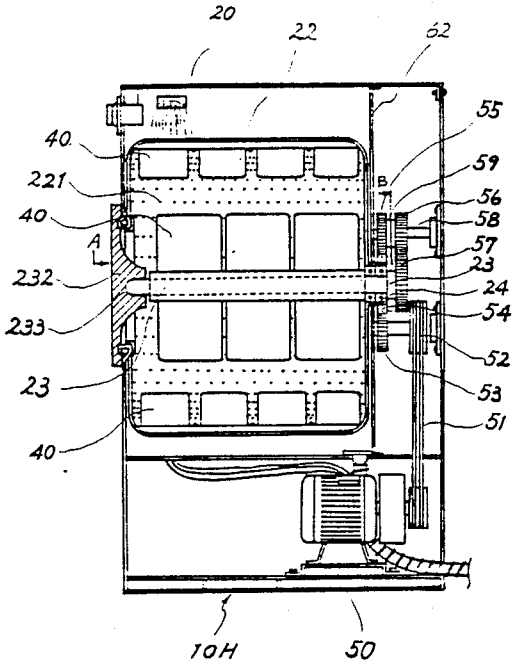
FIG. 7 is a side elevational section of the washing machine in FIG. 6.

The structure of machine 10H is to be detailed with the illustration of FIGS. 7 and 8 wherein gear transmissions and the bearing means of both the basket 22 and the shaft 23 are detailed further.

The front wall of the basket 22 has a central opening with a lipped rim 25 of which the cross section resembles an inverted "L". The lipped rim 25 is retained within an aperture 61 on the front wall of tank 20 of the machine 10H which serves as the front end bearing of the basket. The rear end wall of basket 22 is provided with a hollow sleeve 24 which bears on the rear wall 62 of the tank 20 and which is rotatably driven by a ring gear 54 concentrically mounted around sleeve 24. The rear end of a washing shaft 23 is rotatably retained within said sleeve 24 and is provided with a gear 51. Gear 51 is driven in a direction counter to the rotation of the basket. The front end of the shaft 23 is rotatably mounted in a recess 233 provided in a cover 232. Cover 232 covers up the front aperture of the tank 20 where charge and discharge of washing articles are effected.

The driving system of this embodiment of the invention will now be described. The driving system comprises a prime mover, such as an electric motor 50, through belt 51 and pulley 52, the power is transmitted to a train of gears including a first couple of spur gear 52-53, the latter being in mesh with a ring gear 54 wrapped around a sleeve 24 rotatably retained on the rear wall 62 of the tank 20. Ring gear 54 in twin transmits the movement to a spur gear 55 disposed on a counter shaft 58 of which the rotation is restricted to one way only through a ratchet wheel 59. Coshafted with gear 55 is a gear 56 meshed with a gear 57 fixed on a solid washing shaft 23. By the arrangement of such a gear train, the washing shaft 23 having its rear end rotatably retained in the basket sleeve 24 is capable of revolving counter directionally with the basket 22, with the aid of the ratchet wheel 59, washing shaft 23 is to stay improved during the draining operation of the basket 22.

Figure 9A:
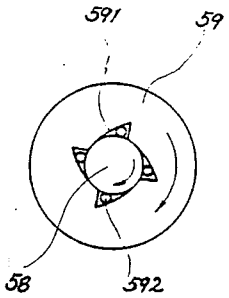
FIG. 9A and 9B are schematic diagrams showing the moving and stationary mode of the rotating shaft.
Figure 9B:
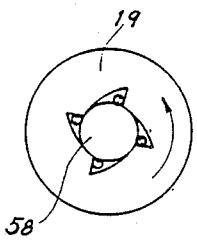

The ratchet wheel 59 is conventional, with balls 592 stuck between ratchets 591 and shaft 58, the latter is rendered immovable such as shown in FIG. 9B. Yet during washing period, shaft 59 rotates synchronous with wheel 58 which allows gear 56 to drive gear 57 to cause the relative and countered rotation of the basket 22 against the shaft 23, so that the pairs of opposited washing boards become effective.

During the draining operation, a higher speed is called for, that can be achieved through the adjustment of the variable speed motor. Perforations 221 are provided on the drum wall so that it serves the purpose of a basket of facilitate drainage. Since the additional function is performed with a same bulk of the machine, space economy is thereby enhanced.

With the washing board so efficiently deployed, the simulation of kneading and rubbing in the hand laundry is perfectly performed, and the entanglement of the washing articles or the granulation of the fabric surface can totally be avoided.

In the case of a horizontal disposing shaft machine, even a half filled water tank can utilize the full extent of the board area because all boards are submerged under water during the revolving of the washing shaft and the drum.

While the above description is made by way of specific embodiments, those skilled in the art may engage numerous modifications without departure from the spirit of the present invention, of which the scopes are defined in the following claims.

I claim:

1. A washing machine having an improved structure that simulates the action of hand laundries comprising:

a water tank having a tank wall with an inner side and an outer side, said inner side of said tank wall being provided with a plurality of slots;

a shaft mounted at the center of the tank for rotatable movement relative to said tank, said shaft being provided with a plurality of slots;

at least a first pair of flexible washing boards diametrically mounted on said shaft so as to extend outwardly toward said tank wall inner side;

at least a second pair of flexible washing boards mounted on the inner side wall of the tank so as to extend inwardly toward said shaft;

and characterized by each said board of said first and second pairs being generally rectangular and having a root side and a tip side with the root side being thicker than the tip side so that the board has a wedge shape, said root side of said board having a protruded shoulder portion to be inserted into corresponding ones of said slots provided alongside said shaft and the inner wall of the tank, the relative movement between the shaft and the tank wall causing the tip sides of said first pair of boards to be able to pass proximately to the tip sides of said second pair of boards so as to simulate kneading and rubbing action of hand laundries.

2. Washing machine according to claim 1, wherein the shaft is vertically disposed.

3. Washing machine according to claim 1 wherein the first pair of boards are rotatable with the shaft to any predetermined angle.

4. Washing machine according to claim 1, wherein said tank wall and the second pair of boards are stationary

.

5. Washing machine according to claim 1, wherein said first set and second set of boards extend a length such that the tips of the opposite pairs of the board overlap during relative movement with each other.

6. Washing machine according to claim 1, wherein the tips of the opposite pairs of the boards are spaced apart from each other so as to provide a gap therebetween.

7. Washing machine according to claim 1, wherein the shaft is horizontally disposed.

8. Washing machine according to claim 7, wherein said tank includes a revolving perforated drum or basket that is concentrically disposed with respect to the shaft, said perforations providing a draining function.

9. Washing machine according to claim 8, wherein said basket has a front wall with a central opening with an inverted "L" shaped lipped rim, has a rear wall, and has a hollow sleeve to be rotatably retained in an aperture and an opening respectively in the front and rear wall of the water tank.

10. Washing machine according to claim 9, wherein the rear end of the shaft is rotatably retained within said sleeve and the front end of the shaft is rotatably mounted in a recess provided in the front aperture cover of the water tank where the loading and unloading of articles to be washed is accomplished.

11. Washing machine according to claim 10, wherein the shaft and the basket are driven through respective members of a transmission gear train and the relative movement between the shaft and the basket during the washing cycle is counter directional.

12. Washing machine according to claim 11, and further including ratchet means for preventing during the drain period.

13. Washing machine according to claim 7 wherein the first pair of the boards are mounted on the shaft and the second pair of boards are mounted on the inner side wall of the drum or basket.

14. Washing machine according to claim 1, wherein said first pair of boards and said shaft oscillate to any predetermined angle.

15. Washing machine according to claim 1 wherein each of said shaft slots and each of said tank slots has a length that is at least as long as the width of two of said first pair of boards and two of said second pair of boards, respectively; and wherein said boards all have a rigidity such that each board extends in the radial direction; and further comprising a third pair of flexible washing boards mounted in said shaft slot next to the corresponding ones of said first set of boards; and a fourth pair of flexible washing boards mounted in said wall slot next to the corresponding ones of said second pair of boards.

16. Washing machine according to claim 15 wherein each of said shaft slots and each of said tank slots have approximately equal lengths and wherein all of said boards have substantially the same dimensions.

17. Washing machine according to claim 15 wherein the boards of said second and fourth pairs of boards are mounted diametrically opposite each other such that said first and second pairs of boards can be located in line with said second and fourth pairs of boards.

* * * * *